United States Patent [19]

Grondahl et al.

[11] 4,030,875

[45] June 21, 1977

[54] INTEGRATED CERAMIC-METAL COMBUSTOR

[75] Inventors: Clayton M. Grondahl, Elnora; Bruce W. Gerhold, Schenectady, both of N.Y.

[73] Assignee: General Electric Company, Schenectady, N.Y.

[22] Filed: Dec. 22, 1975

[21] Appl. No.: 643,540

[52] U.S. Cl. ..... 431/352; 60/39.65

[51] Int. Cl.[2] ..... F23D 15/02

[58] Field of Search ..... 431/352, 353; 60/39.65; 138/37

[56] References Cited

UNITED STATES PATENTS

| | | | |
|---|---|---|---|
| 1,827,246 | 10/1931 | Lorenzen | 60/39.69 |
| 3,589,127 | 6/1971 | Kenworthy et al. | 431/352 X |
| 3,594,109 | 7/1971 | Penny | 431/352 |
| 3,854,503 | 12/1974 | Nelson et al. | 431/352 X |
| 3,880,574 | 4/1975 | Irwin | 431/353 |
| 3,880,575 | 4/1975 | Cross et al. | 431/353 |

*Primary Examiner*—Edward G. Favors

*Attorney, Agent, or Firm*—Leo I. MaLossi; Joseph T. Cohen; Jerome C. Squillaro

[57] ABSTRACT

Integration of separate ceramic parts and metal parts to form a unified combustor is described. The flame holding portion and any other portion where air is introduced into the combustor are made of metal while insulated, imperforate ceramic construction is used for the balance of the combustor liner. In this manner the regions of high local stress are accommodated by cooled metal and the regions of uniform thermal stress are accommodated by resiliently-mounted thermally-insulated ceramic.

11 Claims, 3 Drawing Figures

INTEGRATED CERAMIC-METAL COMBUSTOR

BACKGROUND OF THE INVENTION

This invention is directed to combustion apparatus such as is used in a gas turbine engine, and particularly to a combustion liner structure for such an apparatus.

Gas turbine combustion apparatuses typically include a liner in which combustion is conducted. Such liners ordinarily are of circular or of annular cross-section, with an upstream end called a dome and an outlet at the downstream end for combustion products in flow communication with the turbine inlet. Fuel is introduced at the upstream end and air enters the liner through the upstream end and through the sidewall of the liner to effect combustion and to dilute the combustion products to a suitable temperature.

Although gas turbine combustion liners are typically made of high temperature resisting metal alloys, some combustion apparatuses have been made with walls constructed of various ceramic materials (U.S. Pat. No. 1,827,246 — Lorenzen; U.S. Pat. No. 3,594,109 — Penny; U.S. Pat. No. 3,880,574 — Irwin; U.S. Pat. No. 3,880,575 — Cross et al.; and published Application No. B377,172 — Holden).

While various known ceramics are highly resistant to heat and may be formed into cylinders and other shapes by known techniques, such materials are relatively weak and brittle. Also, ceramic materials have relatively low thermal expansion coefficients, which presents a problem when it becomes necessary to mount them in conjunction with metal components in a combustion apparatus.

Silicon nitride and silicon carbide are typical of the ceramic materials utilized in the prior art, but the nature of the ceramic is a matter of choice providing that the requisite high temperature physical properties and corrosion resistance are obtained.

When gas turbine combustors are made with heat resistant alloy liners, considerable air cooling is required to provide durability at current operating conditions. It is desirable to increase the firing temperature and as this is done, a larger fraction of the air flow is needed for combustion resulting in increased heat transfer to the liner. This will preclude the use of conventional designs for increased firing temperatures, especially when low energy content fuels (e.g., low BTU coal gas) are utilized, which need nearly all of the air for the actual combustion. Thus, there is a developing need for the use of ceramics to accommodate increased firing temperatures, but integration of these materials into a combustion system must be done in a manner that will accommodate the brittle nature of these materials.

DESCRIPTION OF THE INVENTION

Combustor construction filling the needs recited hereinabove is provided by the instant invention. The combustor liner portion within which the combustion process is carried on is able to successfully accommodate both the regions of high local stress and cold spots occurring wherever air flow is introduced into the combustor and the more uniformly heated surfaces wherein premixed air and partially burned fuel are received from an upstream combustion zone. These separate requisites are met by integrating a metal liner length(s) with a ceramic liner length(s), the metal liner length accommodating all air input and the ceramic liner length receiving only premixed air/fuel mixtures whereby the combustion process conducted therein will expose the ceramic surface to relatively uniform heating. To the extent to which each ceramic liner length requires support against inwardly-directed pressure stress and protection from incoming combustion air, a metal housing is provided outwardly above the ceramic liner length with thermal insulation disposed between the metal and the ceramic. Inwardly directed flow deflection means are provided upstream of each ceramic liner length, which has a metal liner length disposed immediately upstream thereof. In the preferred construction, the ceramic liner length consists of resiliently biased. imperforate segments. The number and disposition of liner lengths is dependent upon the nature of the combustion process to be conducted within the combustor.

By the use of this integrated combustor design air is available for cooling the reduced metal area as required with enough additional air to accommodate the combustion as firing temperatures are increased.

BRIEF DESCRIPTION OF THE DRAWINGS

The features of this invention believed to be novel are set forth with particularity in the appended claims. The invention itself, however, as to the organization, method of operation, and objects and advantages thereof, may best be understood by reference to the following description taken in conjunction with the accompanying drawings wherein:

MANNER AND PROCESS OF MAKING AND USING THE INVENTION

Figure 1:
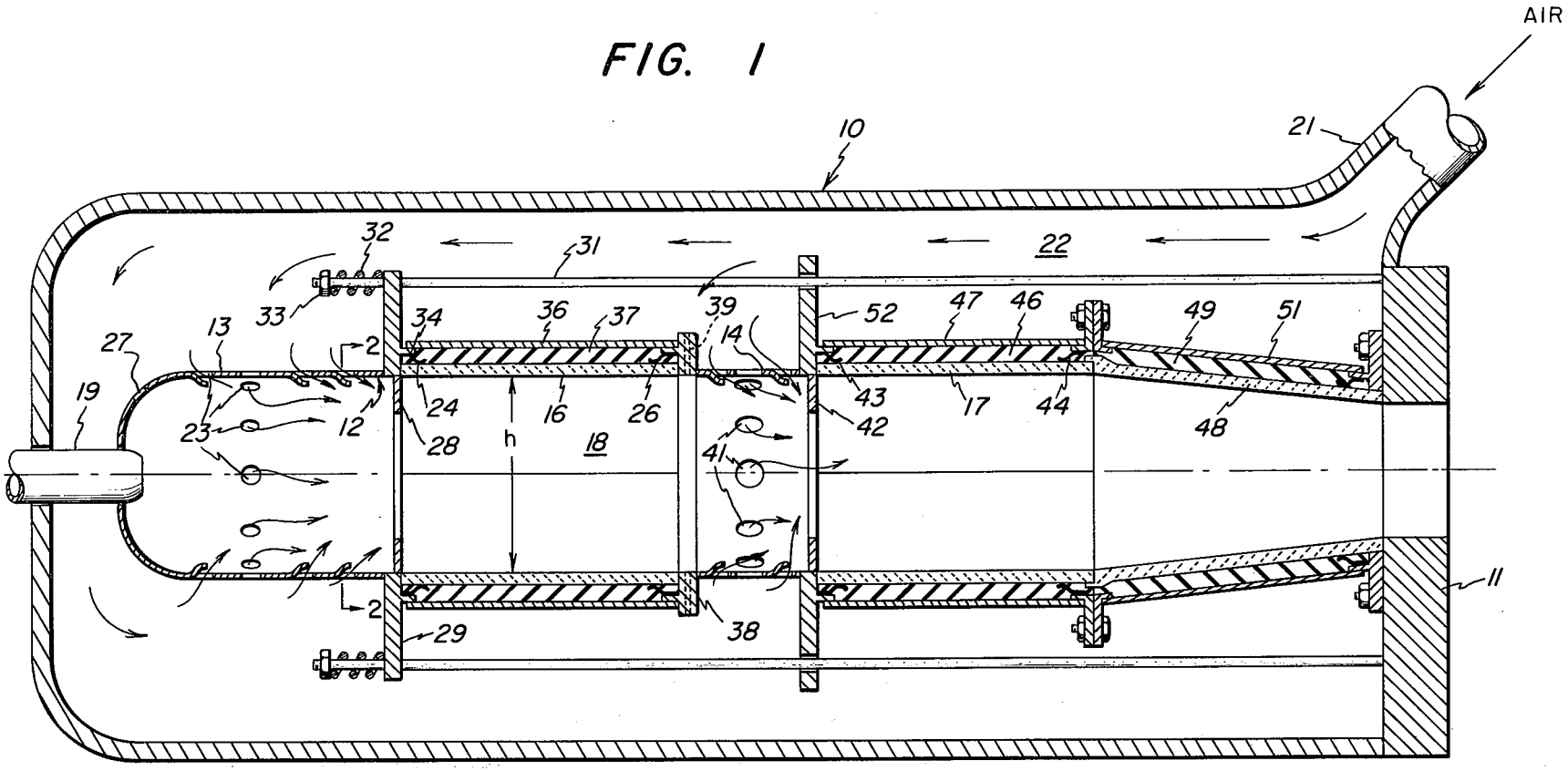
FIG. 1 is a view in section schematically illustrating the combustor for a gas turbine embodying the teachings of the present invention (as illustrated this view can be representative of either a can-type or an annular-type combustor)

Referring to FIG. 1 of the drawings, gas turbine combustor 10 may be mounted in a suitable space within the engine affixed to the nozzle diaphragm 11. The integrated, continuous combustion liner 12 is composed of metallic liner lengths 13,14 and ceramic liner lengths 16,17. In this respect, "continuous" will mean not having any annular openings between a metallic liner length and an adjacent ceramic liner length. Such liners ordinarily are of circular or annular cross-section, with the upstream end accommodating the primary combustion zone and secondary combustion occurring downstream within the combustion liner.

The term "ceramic liner length" refers to an expanse of ceramic surface enclosing a portion of the combustion volume to define the flow of hot gases whether constructed in a single piece or made up of segments.

Fuel from a fuel reservoir (not shown) enters combustion chamber 18 via fuel injector 19. Air for the combustion process is supplied via conduit 21 passing through annular space 22. Air for the combustion in the primary zone (flame holding portion) enters through holes 23 in the head end metal liner length 13 of combustor liner 12. The fuel and air injections into the primary zone are such as to develop a highly turbulent region in which rapid mixing of fuel and air takes place and in which rapid combustion of the mixed reactants occurs.

The hot gaseous products resulting from the primary combustion move downstream within combustion liner 12 into the zone defined by ceramic liner length 16 wherein combustion initiated in the primary zone will essentially be completed. Preferably ceramic liner length 16 will consist of a plurality of longitudinally extending segments held in place by annular springs 24,26 in a resilient fashion. The entire expanse of ceramic in liner length 16 will be free of holes, the requisite air addition having been accomplished via holes 23. Hole 27 is provided in the head end to accommodate an igniter (not shown). By avoiding the presence of cooling louvers or air addition holes in any portion of ceramic liner length 16, areas of high local stress are avoided contributing markedly to the structural integrity of the ceramic.

Figure 2:
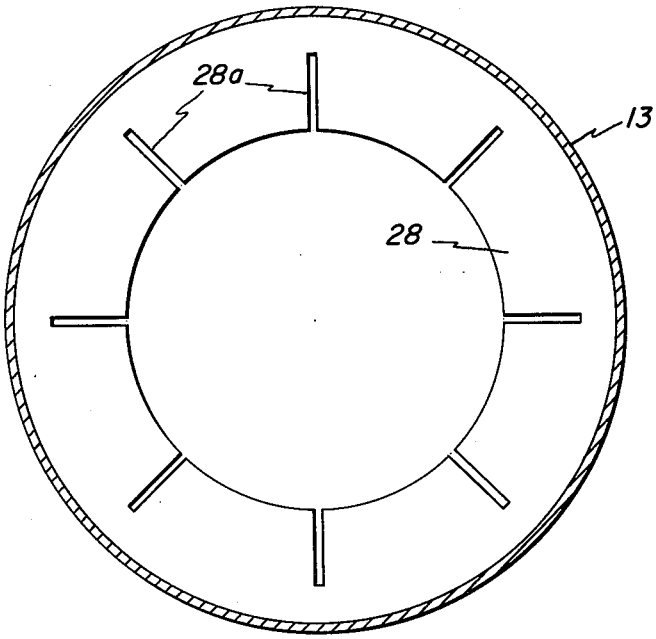
FIG. 2 is a section taken on line 2—2 of FIG. 1 considering FIG. 1 as representative of a can-type combustor and FIG. 3 is a cross-sectional view of alternate construction for the inwardly directed flow deflection means shown in FIG. 2.

Also, by avoiding air addition in the vicinity of liner 16, cold spots, which would increase thermal stresses in the ceramic are avoided. To insure against such cold spots from the upstream introduction of air, inwardly projecting annular plate 28 is provided to deflect incoming air flow away from the upstream end of ceramic liner length 16 until requisite mixing with the combustion gases has occurred. As shown in FIG. 2 provision is made for the thermal expansion and contraction of plate 28 by the introduction of discontinuities 28*a* therein.

Flange 29, welded to the downstream extremity of metal liner length 13 serves to resiliently align the several portions of integrated combustion liner 12 via the tie rods 31 and springs 32 held in place by nuts 33 threaded onto rods 31. Expansion and contraction of combustion liner 12 is thereby accommodated. Projection 34 formed on flange 29 accommodates both spring 24 at its underside and a slip fit with the metal housing 36 to accommodate relative motion due to differential thermal expansion of housing 36. Insulation layer 37 is disposed between ceramic liner length 16 and metal housing 36. Metal housing 36 is affixed at the downstream end thereof as by welding to flange 38.

Thus, several aspects of construction are provided in the preferred construction to accommodate the various applications of stress. Hoop stress in the ceramic material is minimized by segmentation in the axial direction (e.g., for a construction of circular cross-section, three arc segments of 120° each can be used). Such segmentation relieves hoop stresses by eliminating the load bearing capability of the ceramic body in the circumferential direction. The assembly of imperforate segments is insulated thermally from the metal housing 36 as described above in order to control heat transmission thereto to enable housing 36 to more effectively bear the differential pressure stress applied radially inward thereaginst. The transit of incoming combustion air via passage 22 cools housing 36 (and adjacent elements) further optimizing the ability thereof to function in accommodating differential pressure stresses applied thereto. In addition, insulation layer 37 minimizes radial thermal stress in the ceramic wall in that the radial thermal gradient therethrough is reduced,. This is in contrast to the situation that would prevail if ceramic length 16 were to be exposed to the incoming combustion air on its outer surface and be cooled thereby while being heated on the gas side by the combustion occurring there. This latter situation is illustrated in the aforementioned Penny, Irwin and Cross et al. patents. Ceramic liner length 16 is restrained mechanically, both axially and radially, by this construction in a resilient fashion to accommodate thermal expansion.

Although conventional materials may be utilized for the structural elements required for the practice of this invention, silicon/silicon carbide (Si/SiC) is preferred because of its ease of fabrication and its physical properties, particularly its high thermal conductivity, which is comparable to that of iron, and its high tensile rupture strength. The high thermal conductivity relieves thermal gradients and the high tensile rupture strength provides the capability for withstanding unavoidable thermal stress. The maximum working temperature of the Si/SiC ceramic is 1400° C. (2250° F.), however, control of the heat loss through insulation layer 37 (e.g., by varying the thickness of the insulation layer along the combustion path (axially of the combustor)) cooling of the ceramic can be programmed to facilitate operation at still higher gas temperatures. The preparation of a shaped Si/SiC matrix composite is described in U.S. patent application Ser. No. 572,969 Laskow and Morelock, filed Apr. 30, 1975. The Laskow et al. application is assigned to the assignee of the instant invention and is incorporated by reference.

In the constructure shown, the inner surface of flange 38 is exposed to the combustion gases and cooling thereof is required. This is accomplished by the introduction of coolant passages 39 therethrough whereby incoming air can be introduced to provide the requisite cooling.

Further downstream, second stage air is brought into and mixed with the hot primary gaseous products via holes 41 (larger than holes 23) in metal liner length 14. The entry of this air is accomplished in a manner to provide rapid mixing with the primary gaseous products whereby these hot gaseous products are burned. The ceramic liner length 17 functions in the same manner as described hereinabove for ceramic liner length 16 confining the continuation of the combustion process resulting from the introduction of air via holes 41. Protection of the liner length 17 and mechanical support thereof is accommodated in the same manner as described hereinabove by the use of ring 42 (analogous in function to element 28), annular ceramic containment springs 43,44, insulation layer 46, and metal housing 47.

Although transition piece 48 connected to the downstream end of combustion liner 12 is shown as being constructed in one piece and of ceramic, such construction is not a requisite of this invention and transition pieces of conventional construction may be employed. In the event that transition piece 48 is made of ceramic material, however, the outer surface thereof should be covered with insulation layer 49 and metal housing 51 should be provided to accommodate differential pressure stresses.

As shown, tie rods 31 provide added alignment and support for the liner 12 via flange 52. Fuel nozzle 19 is loosely fitted into liner length 13 to accommodate movement of liner 12 relative thereto upon expansion and contraction thereof.

Figure 3:
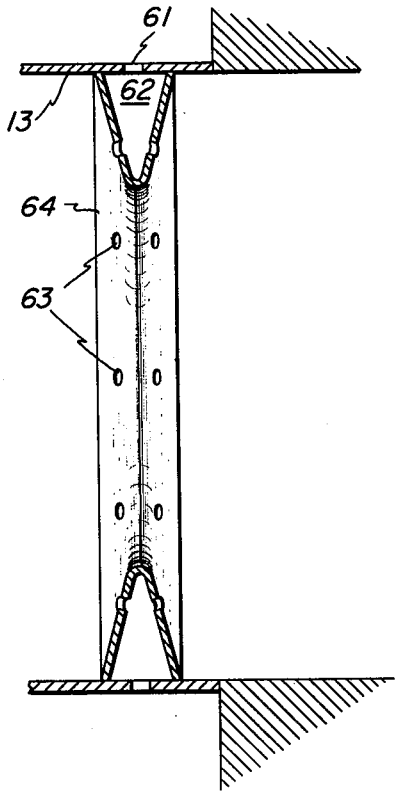

Alternate construction for the flow deflection element 28 comparable to that shown in FIG. 2 is shown in FIG. 3. Air is provided through holes 61 into manifold 62 to exit via holes 63 to cool flow deflection element 64.

The length of the head end metal liner length 13 should be in the range of from 0.5 to 2.0 *h* (in a can-type combustor *h* represents the inner diameter, while in annular combustors, *h* represents the internal dome height).

BEST MODE CONTEMPLATED

As has been stated hereinabove, the particular combustion process to be carried on in the gas turbine combustion apparatus will determine the number and disposition of ceramic and metal liner lengths and the construction arrangement disclosed in FIG. 1 together with the description thereof present a combustion apparatus particularly applicable for the burning of low BTU product gases obtained by the gasification of coal. A combustion process particularly suitable for the burning of such a fuel is described in U.S. patent application Ser. No. 625,120 — Martin, filed Oct. 23, 1975. The Martin application is assigned to the assignee of the instant invention and is incorporated by reference. Also, the construction specifically illustrated in FIG. 1 is particularly useful in carrying out the general combustion process disclosed in the Martin application for reducing the production of oxides of nitrogen derived from fuel-bound nitrogen.

However, when using high BTU fuels (e.g., hydrocarbons such as oil) the construction shown in FIG. 1 would be modified. For example, ceramic liner length 17 and the mechanical support and protective structures appurtenant thereto would not be used. In such a modification, the transition piece would connect with the particular metal liner length utilized downstream of ceramic liner length 16. Also, when high BTU fuels are used in high temperature technology machines, such as the liquid-cooled turbine construction described in U.S. Pat. No. 3,446,481 — Kydd, metal liner length 14 also would not be used.

What we claim as new and desire to secure by Letters Patent of the United States is:

1. In a gas turbine combustion apparatus wherein said combustion apparatus is lined on the inside with a layer of ceramic material confining the sequential zones of combustion maintained downstream of means for introducing fuel into said combustion apparatus, means are provided in flow communication with the outside of the combustion liner for supplying air, holes are located passing through the combustion liner in flow communication with said means for supplying air for the transport of air through said combustion liner into said combustion apparatus and means are disposed at the downstream end of said combustion apparatus for conducting the combustion products from said combustion liner into a turbine structure, the improvement comprising:

a continuous combustion liner construction in which at least one metal liner length and one ceramic liner length are disposed in series, said one metal liner length being disposed upstream of said one ceramic liner length;

each ceramic liner length being free of holes through the wall thereof in flow communication with said means for supplying air, the requisite holes being located in each metal liner length employed.

2. The improvement of claim 1 wherein inwardly directed means for deflecting cooling air is disposed upstream of and adjacent to any ceramic liner length.

3. The improvement recited in claim 1 wherein the cooling air deflecting means is a notched annular plate.

4. The improvement recited in claim 1 wherein the cooling air deflecting means is adapted for air flow therethrough.

5. The improvement recited in claim 1 wherein the at lease one ceramic liner length comprises a plurality of imperforate segments.

6. The improvement recited in claim 5 wherein the segmentation is in the generally longitudinal direction.

7. The improvement recited in claim 1 wherein a plurality of metal liner lengths are diposed in alternate series arrangement with a plurality of ceramic liner lengths.

8. The improvement recited in claim 1 wherein the at least one ceramic liner length is housed within a pressure-resisting metal housing, each such housing being thermally insulated from the ceramic liner length contained thereby.

9. The improvement recited in claim 8 wherein the value of the thermal resistance along the ceramic liner length is varied significantly in the direction of combustion product flow along said combustion liner length.

10. The improvement recited in claim 8 wherein the outer surface of each pressure-resisting metal housing is exposed to air flow in the means for supplying air.

11. The improvement recited in claim 1 wherein each ceramic liner length is resiliently supported to permit thermal expansion thereof.

* * * * *